US005607548A

United States Patent [19]

Pettersson

[11] Patent Number: 5,607,548

[45] Date of Patent: Mar. 4, 1997

[54] PROCESS FOR DIVIDING THE SULPHIDE CONTENT OF THE GREEN LIQUOR FOR THE PRODUCTION OF WHITE LIQUORS HAVING HIGH AND LOW SULPHIDITY

[75] Inventor: Bertil Pettersson, Gävle, Sweden

[73] Assignee: Kvaerner Pulping Technologies, Karlstad, Sweden

[21] Appl. No.: 397,253

[22] PCT Filed: Sep. 29, 1993

[86] PCT No.: PCT/SE93/00782

§ 371 Date: Mar. 23, 1995

§ 102(e) Date: Mar. 23, 1995

[87] PCT Pub. No.: WO94/09204

PCT Pub. Date: Apr. 28, 1994

[30] Foreign Application Priority Data

Oct. 12, 1992 [SE] Sweden ..... 9203005

[51] Int. Cl.[6] ..... D21C 11/04

[52] U.S. Cl. ..... 162/30.11; 162/30.1; 159/47.3

[58] Field of Search ..... 162/29, 30.1, 30.11; 159/147.3; 423/DIG. 3

[56] References Cited

U.S. PATENT DOCUMENTS

| | | | |
|---|---|---|---|
| 1,906,886 | 5/1933 | Richter . | |
| 3,617,434 | 11/1971 | Nakafuri et al. | 162/30 |
| 4,093,508 | 6/1978 | Henricson | 162/30 K |
| 4,941,945 | 7/1990 | Pettersson | 162/29 |

FOREIGN PATENT DOCUMENTS 923256 3/1973 Canada .

*Primary Examiner*—Donald E. Czaja
*Assistant Examiner*—Dean T. Nguyen
*Attorney, Agent, or Firm*—Bacon & Thomas

[57] ABSTRACT

The invention relates to a process for dividing up the sulphide content of green liquor into a sulphide-rich part and a sulphide-poor part by crystallizing out sodium carbonate ($Na_2CO_3$). The crystallization of the sodium carbonate is effected by evaporating green liquor with a ratio of hydroxide ions [$OH^-$] and sulphide ions [$HS^-$] such that the liquor which is obtained after evaporation and separation of the solid phase has high sulphidity and an acceptably low content of carbonate ions [$CO_3^{2-}$]. Prior to evaporation, the hydroxide ion content in the liquor is increased by adding quicklime (CaO). The solid phase (sodium carbonate and calcium carbonate) which has been separated off is diluted with water so that the sodium carbonate crystals go into solution and at the same time the solution is given a cation content which favours the causticization which is subsequently undertaken. The causticization is carried out in a conventional causticization plant. After separating off the lime sludge ($CaCo_3$) which is formed during the causticization processes, a white liquor of low sulphidity and low carbonate content is obtained for use in the cooking process and, after oxidation, also in the oxygen gas delignification prior to final bleaching of the pulp.

3 Claims, 1 Drawing Sheet

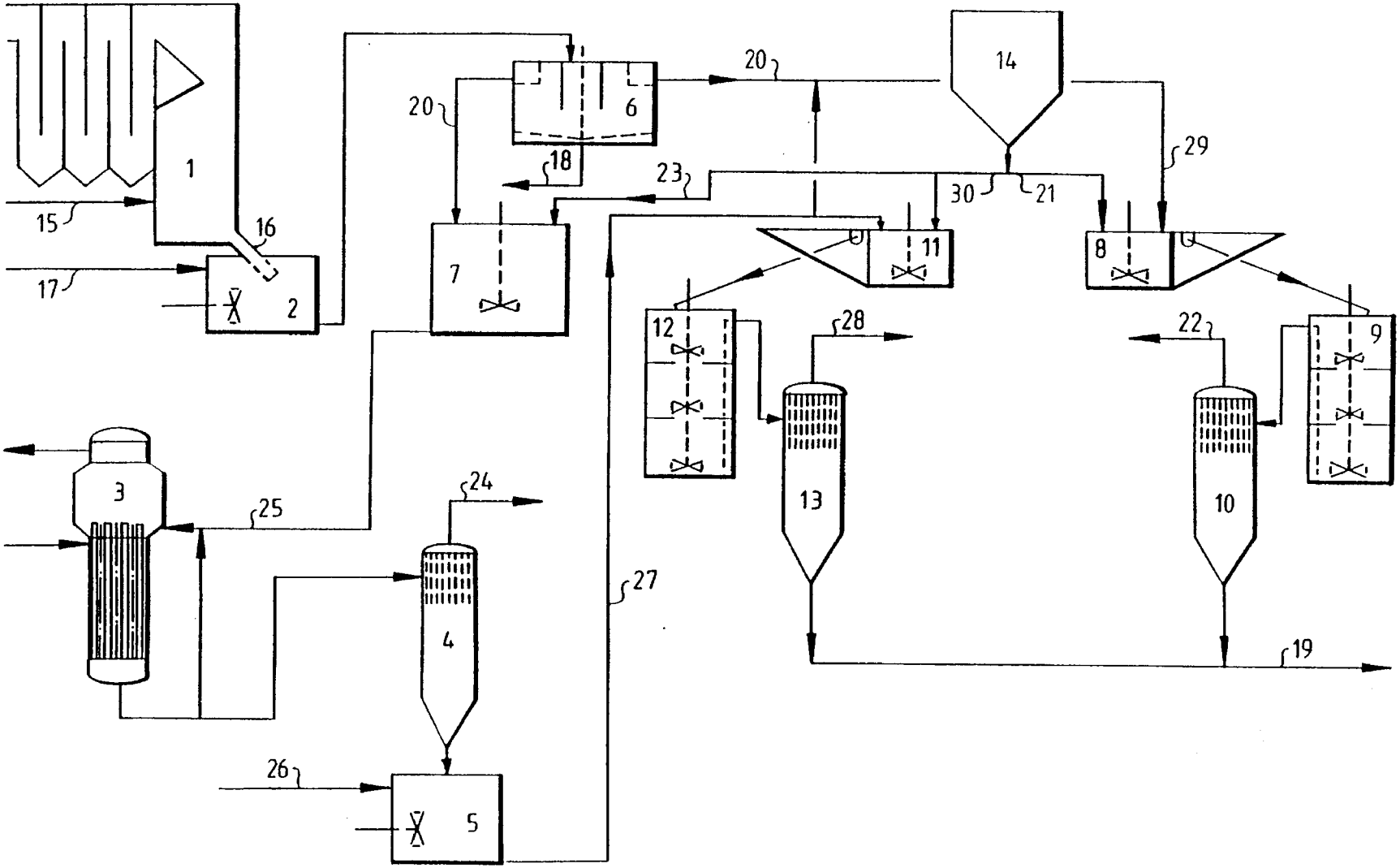
1
2
3
4
5
6
7
8
9
10
11
12
13
14
15
16
17
18
19
20
20
21
22
23
24
25
26
27
28
29
30

PROCESS FOR DIVIDING THE SULPHIDE CONTENT OF THE GREEN LIQUOR FOR THE PRODUCTION OF WHITE LIQUORS HAVING HIGH AND LOW SULPHIDITY

BACKGROUND AND SUMMARY OF THE INVENTION

When producing pulp in accordance with the sulphate pulp method, the wood is digested in the form of chippings in an alkaline solution chiefly consisting of sodium hydroxide and sodium hydrosulphide. The relative proportions of hydroxide ions [$OH^-$] and sulphide ions [$HS^-$] vary from plant to plant but normally within the interval 25–40% sulphide [$2HS^-$], calculated on the basis of the sum of the contents of sulphide and hydroxide ions.

An increased content of sulphide ions in relation to hydroxide ions in the cooking liquid increases the pulp yield and normally improves the important properties of the final product.

At the beginning of the cooking process, the so-called impregnation phase, an increased proportion of sulphide ions provides the possibility of achieving a more efficacious dissolution of lignin during the cooking process itself. A lower content of hydroxide ions in this part of the cooking process decreases the breakdown of cellulose, thereby increasing the yield and improving the quality of the final product.

Recently, the cooking process has been modified in order to increase the yield of the pulp and to improve its properties. This has been done by dividing up the alkali charge which is required by adding a part of the cooking liquid (the white liquor) in the conventional manner together with the wood and then adding the remaining quantity later in the cooking process. However, the ratio between the sulphide and hydroxide ions remains the same in the white liquor which is added. In certain cases, an increased recirculation of spent liquor (black liquor) to the beginning of the cooking process has been effected with a view to obtaining a higher content of suliphide ions in this stage of the cooking.

The present invention provides the possibility of apportioning sulphide and hydroxide ions within wide limits by dividing up the available alkali after the liquor combustion into two or more constituent streams.

BRIEF DESCRIPTION OF THE DRAWING

FIG. 1 schematically illustrates the system utilized in the practice of the present invention.

DETAILED DESCRIPTION OF THE DRAWING

The major portion of the cooking chemicals are present, together with organic material released from the wood, in the spent liquor (black liquor) which is conveyed, after evaporation down to combustible dry manner, to the liquor combustion process (15), which is normally a conventional recovery boiler (1) but which can also be a liquor gasification plant. The greater part of the cooking chemicals are recovered in the combustion process and usually leave the process in smelted form (16). The recovered chemicals are present in the main as sodium carbonate ($Na_2CO_3$) and sodium sulphide ($Na_2S$) and are dissolved in a weakly alkaline washing liquid (17) (weak liquor) which was obtained by washing calcium carbonate ($CaCO_3$), usually termed lime sludge, which separated off in the causticization process. After dissolution in the soda dissolver (2), the strongly alkaline liquid is termed green liquor.

On dissolution, the sodium sulphide reacts in accordance with the formula:

$$Na_2S+H_2O=NaOH+NaHS$$

The reaction thus provides 1 mol of $(OH)^-$ per mol of $Na_2S$.

If metals other than sodium are present in the liquor combustion process and with the aim of producing a so-called autocausticization, this also provides an additional contribution of hydroxide ions in the green liquor.

The weak liquor in which the alkali smelt is dissolved contains varying quantities of hydroxide ions ($OH^-$) depending on the systems for separating off and washing the green liquor sludge (18) and the lime sludge (19).

The content of hydroxide ions in the green liquor after dissolving the alkali smelt is normally within the range 0.8–1.2 kmol, with a cation content of 4.0–4.5 kmol per $m^3$. The solid particles in the green liquor, consisting of elements which are foreign to the process (EFP), are normally separated off either by means of sedimentation (6) or filtration. The purified green liquor (20) then proceeds to the lime-slaker (8) where quicklime from the lime store 14 is metered-in to an extent (21) such that, after causticization (9), the white liquor (22), separated off in the white liquor filter (10), contains the desired hydroxide content, normally 2.8–3.0 kmol per $m^3$.

In the present invention, a part or the whole of the purified green liquor (20), depending on the requirement for white liquor of high sulphidity, is taken to a mixing tank (7) (combined lime-slaker and causticization vessel) where a part of the total lime requirement is added (23) in a quantity such that the desired ratio between sulphide ions ($HS^-$) and hydroxide ions ($OH^-$) is obtained in the white liquor of high sulphidity (24).

In order to exploit the invention to the optimal extent, it is expedient to evaporate a green liquor having a hydroxide ion concentration within the range of 1.3–1.8 kmol per $m^3$. This level is achieved by adding 10–40% of the total requirement for quicklime to the green liquor prior to evaporation.

In the main alternative, the quicklime is added to the purified green liquor in the combined slaker/causticization vessel (7) and is supplied to the evaporation plant (3) via the conduit (25). The evaporation can be effected in a conventional multi-step evaporation. The lime sludge which is formed during the causticization can be separated off entirely or in part prior to the evaporation. The latter alternative is not shown in the diagram, but can be effected by a filter (4) being placed in the conduit (25). It is advantageous if the lime sludge, or a part thereof, remains in the liquor during the evaporation process since the lime sludge particles constitute excellent precipitation surfaces for compounds of the "pirsonite" type, or similar compounds, which are precipitated out during the evaporation and are inclined to form incrustations and which otherwise would stick to the heated surfaces and impair the evaporation capacity.

The sodium carbonate ($Na_2CO_3$) which was precipitated out during the evaporation process is separated off, together with the lime sludge, in a filter plant (4), with the white liquor of high sulphidity, which is ready for the cooking process, leaving the plant in the conduit (24). The sodium carbonate ($Na_2CO_3$) and the lime sludge ($CaCO_3$) are conveyed to a dissolver (5). Water is supplied (26) to the dissolver in a quantity such that the cationic strength of the dissolved substances is in the range 4.0–4.5 kmol per $m^3$.

From the dissolver (5), the solution is transported (27) to lime-slakers (8) or (11), depending on whether the whole or a part of the green liquor passed through the evaporation plant (3).

In the latter case, three different sulphidity levels can be achieved by slaking and causticizing the solution from the dissolver (5) in the plants (11) and (12), with a sulphide-poor whine liquor being obtained from the filter (13) in the conduit (28), at the same time as a white liquor of normal sulphidity is obtained from the constituent stream (29) of green liquor which goes to the lime-slaker (8) and thence to the white liquor filter (10) via the causticization vessel (9). In this case, the total lime requirement for the causticization process is apportioned to the constituent streams (23), (30) and (21).

EXAMPLE quicklime (CaO) is added to a conventional green liquor, for adjustment of the hydroxide ion content, so that the desired ratio between hydroxide ions [$OH^-$] and sulphide ions [$HS^-$] was obtained. The liquor was evaporated and the sodium carbonate which had crystallized out, and the lime sludge ($CaCO_3$) from the causticization, were separated off by filtering.

Result

Composition of the green liquor:

[$OH^-$]=0.980 mol/l

[$HS^-$]=0.815 mol/l

[$CO_3^{2-}$]=1,210 mol/l

Composition of the liquor prior to evaporation:

(About 15% of the total lime requirement utilized)

[$OH^-$]=1.300 mol/l

[$HS^-$]=0,815 mol/l

[$CO_3^{2-}$]=1.050 mol/l

Composition of the liquor after evaporation and separating off of the solid phase:

[$OH^-$]=4.420 mol/l

[$HS^-$]=2,770 mol/l

[$CO_3^{2-}$]=0,275 mol/l

| | | |
|---|---|---|
| Total titratable alkali | TTA | 310 g/l |
| Active alkali | AA | 238 g/l |
| Effective alkali | EA | 177 g/l |
| Sulphidity | | 77 % |
| Degree of causticization | | 75 % |

I claim:

1. In a process for recovering chemicals from the waste liquor in a sulphate pulping process, wherein the waste liquor from the pulping is concentrated by evaporation and the concentrated waste liquor is burned in a combustor to produce a smelt mainly containing sodium carbonate and sodium sulfide, the melt is dissolved in an aqueous solution to produce green liquor and the green liquor is causticized to produce a white liquor containing sodium hydroxide, sodium sulphide, and sodium carbonate, the improvement which comprises:

(a) adding quick lime or hydrated lime to the green liquor in a combined slaking causticizing vessel to form the white liquor containing 1.3–1.8 kmol/$m^3$ of hydroxide ion concentration;

(b) evaporating the white liquor in an evaporator to crystallize the sodium carbonate in the cooking liquor;

(c) separating off the sodium carbonate crystals in a first filter to obtain a sulphide-rich white liquor and sodium carbonate crystals;

(d) dissolving the sodium carbonate crystals to form an alkaline solution of low sulphide content;

(e) adding quicklime to the alkaline solution of low sulphide content in a second causticizing vessel to obtain a slurry containing sulphide-low white liquor and lime sludge, and (f) separating off the lime sludge from the slurry in a second filter to obtain a sulphide-low white liquor.

2. The process of claim 1, wherein the hydroxide ion content of the dissolved cooking chemicals is adjusted to the stated range and the cation content is between 4.0–4.5 kmol/$m^3$.

3. The process of claim 2, wherein the lime sludge ($CaCO_3$) formed during the causticization is supplied, wholly or in part, to the evaporation plant (3) together with the dissolved cooking chemicals.

* * * * *